United States Patent [19]

Dobrick et al.

[11] Patent Number: 4,971,251

[45] Date of Patent: Nov. 20, 1990

[54] SPRAY GUN WITH DISPOSABLE LIQUID HANDLING PORTION

[75] Inventors: Robert P. Dobrick, New Brighton; Dee L. Johnson, Woodbury; Dennis M. Cheesebrow, Roseville; Earl T. LaPlante, New Ulm, all of Minn.

[73] Assignee: Minnesota Mining and Manufacturing Company, St. Paul, Minn.

[21] Appl. No.: 405,454

[22] Filed: Sep. 11, 1989

Related U.S. Application Data

[63] Continuation-in-part of Ser. No. 276,641, Nov. 28, 1988.

[51] Int. Cl.[5] ..... B05B 7/30

[52] U.S. Cl. ..... 239/346; 239/369; 239/371; 239/390; 239/600; 222/145; 222/541; 222/630

[58] Field of Search ..... 239/309, 310, 311, 315, 239/316, 327, 328, 337, 340, 346, 369, 371, 390, 423, 271, 272; 222/107, 129, 136, 145, 541, 630, 637, 95; 206/219, 222; 383/38; 267/166.1

[56] References Cited

U.S. PATENT DOCUMENTS

| | | | |
|---|---|---|---|
| 2,310,633 | 2/1943 | Heimburger | 299/86 |
| 2,649,298 | 8/1953 | Wulff et al. | 267/62 |
| 2,932,385 | 4/1960 | Bollmeier et al. | 206/47 |
| 3,074,544 | 1/1963 | Bollmeier et al. | 206/47 |
| 3,087,606 | 4/1963 | Bollmeier et al. | 206/47 |
| 3,201,047 | 8/1965 | Danberg | 239/336 |
| 3,255,972 | 6/1966 | Hultgren et al. | 239/318 |
| 3,300,042 | 10/1967 | Gordon | 207/62 |
| 3,432,104 | 3/1969 | Kaltenbach | 239/328 |
| 3,780,950 | 12/1973 | Brennan | 239/306 |
| 3,938,706 | 2/1976 | Cohen | 222/95 |
| 4,062,475 | 12/1977 | Harris et al. | 222/95 |
| 4,138,036 | 2/1979 | Bond | 222/464 |
| 4,322,020 | 3/1982 | Stone | 222/95 |
| 4,637,061 | 1/1987 | Riese | 383/38 |
| 4,804,144 | 2/1989 | Denman | 239/346 |
| 4,893,731 | 1/1990 | Richter | 222/105 |

FOREIGN PATENT DOCUMENTS 265588 2/1966 Australia .

OTHER PUBLICATIONS

Page 19 and Cover pages of Catalog entitled "Mechanical Service Products", (Copyright 1986).

*Primary Examiner*—Andres Kashnikow
*Assistant Examiner*—Christopher G. Trainor
*Attorney, Agent, or Firm*—Donald M. Sell; Walter N. Kirn; James D. Christoff

[57] ABSTRACT

A liquid spray gun including (1) a reusable air gun portion including a manually operable valve for controlling air flow; and (2) a disposable container and spray nozzle assembly including a sheet of flexible material having portions attached together and to a central portion of a tube to form a chamber, a liquid in the chamber, and an aspirating nozzle connected to the tube and adapted to be releasably coupled to the air gun portion so that upon movement of air through the nozzle liquid in the chamber will be entrained in that air and sprayed from the nozzle. The assembly can include a coil comprising a strip disposed in a plurality of wraps about an axis and having a spring temper biasing the strip to an axially extended position to form a tube like structure, with an end portion of the coil positioned around an end portion of the tube within the bag so that during spraying the tube like structure will insure that most of the liquid can be dispensed from the chamber. The sheet of flexible material also includes edge segments that are not attached together to thereby form vents for communicating the chamber to the atmosphere.

5 Claims, 2 Drawing Sheets

SPRAY GUN WITH DISPOSABLE LIQUID HANDLING PORTION

This application is a continuation-in-part of application Ser. No. 07/276,641, filed Nov. 28, 1988.

TECHNICAL FIELD

The present invention relates to air operated liquid spray guns.

BACKGROUND

Air operated liquid spray guns have typically contained passageways that are difficult to clean except by passing a solvent through the gun. Such spray guns have thus not been practical for use to spray liquids such as two part epoxies that cure and subsequently can not be removed by solvents, or liquids that are not easily removed by solvents, or are only removed by solvents that are extremely expensive or dangerous to use.

DISCLOSURE OF INVENTION

The present invention provides a spray gun with a disposable liquid handling portion that is sufficiently inexpensive that it can be disposed of after use, thus allowing a user to spray liquids that can not, or can not easily, economically or safely be removed from a conventional spray gun, which spray gun is useful for spraying many types of liquids including relatively heavy-bodied or high viscosity liquids such as those above 10,000 centipoise.

According to the present invention there is provided a liquid spray gun comprising (1) a reusable air gun portion including a manually engageable handle, having means defining a through passageway including an inlet portion adapted to be attached to a source of air under pressure and an outlet portion, and a manually operable valve in the through passageway for controlling the flow air through the passageway; and (2) a disposable container and spray nozzle assembly comprising a tube, at least one sheet of tough flexible material having portions attached together and to a central sealing portion of the tube to form a bag like container defining an internal chamber in which liquid is contained with an inlet end portion of the tube within the chamber and an outlet end portion of the tube outside of the chamber. The assembly also includes a nozzle having a liquid inlet port connected to the outlet portion of the tube with the through opening in the tube communicating with the liquid inlet port, an air inlet port releasably coupled to the outlet portion of the reusable air gun portion, a spray tip portion having an outlet opening, a through opening communicating between the outlet opening and the liquid and air inlet ports, and venturi means for forming a vacuum at the fluid inlet port upon movement of air into the air inlet port and out the outlet opening in the nozzle so that atmospheric pressure will bias liquid in the chamber into the inlet port to be entrained in air passing out of the outlet opening of the nozzle. The assembly further includes a vent for communicating the chamber with the atmosphere.

The chamber defined by the sheet may be undivided, and the inlet end portion of the tube may extend toward the end of the chamber opposite its inlet end portion to insure that most of the liquid within the chamber can be dispensed through the spray gun. Alternatively, the sheet or sheets forming the chamber can be attached together along one or more transverse lines of temporary attachment (as is taught in U.S. Pat. No. 2,932,385, incorporated herein by reference to separate the chamber into parts with the inlet end portion of the tube positioned in one part of the chamber and disposed generally at a right angle to the adjacent temporary attachment line and components of the liquid separated in different parts of the chamber. The assembly can then include a novel coil comprising a strip disposed in a plurality of wraps about an axis and having a spring temper biasing the strip to an axially extended position with successive wraps of the strip material having opposite edge portions overlapping to form a tube like structure, with an end portion of the coil positioned around the inlet end portion of the tube and the coil retained by the temporary attachment line in one part of the chamber with the wraps overlying each other. The temporary attachment line(s) can then be manually separated to afford movement of the coil to its axially extended position extending toward the end of the chamber opposite the tube so that during spraying it will insure that most of the liquid can be dispensed from the chamber.

DETAILED DESCRIPTION

Figure 1:
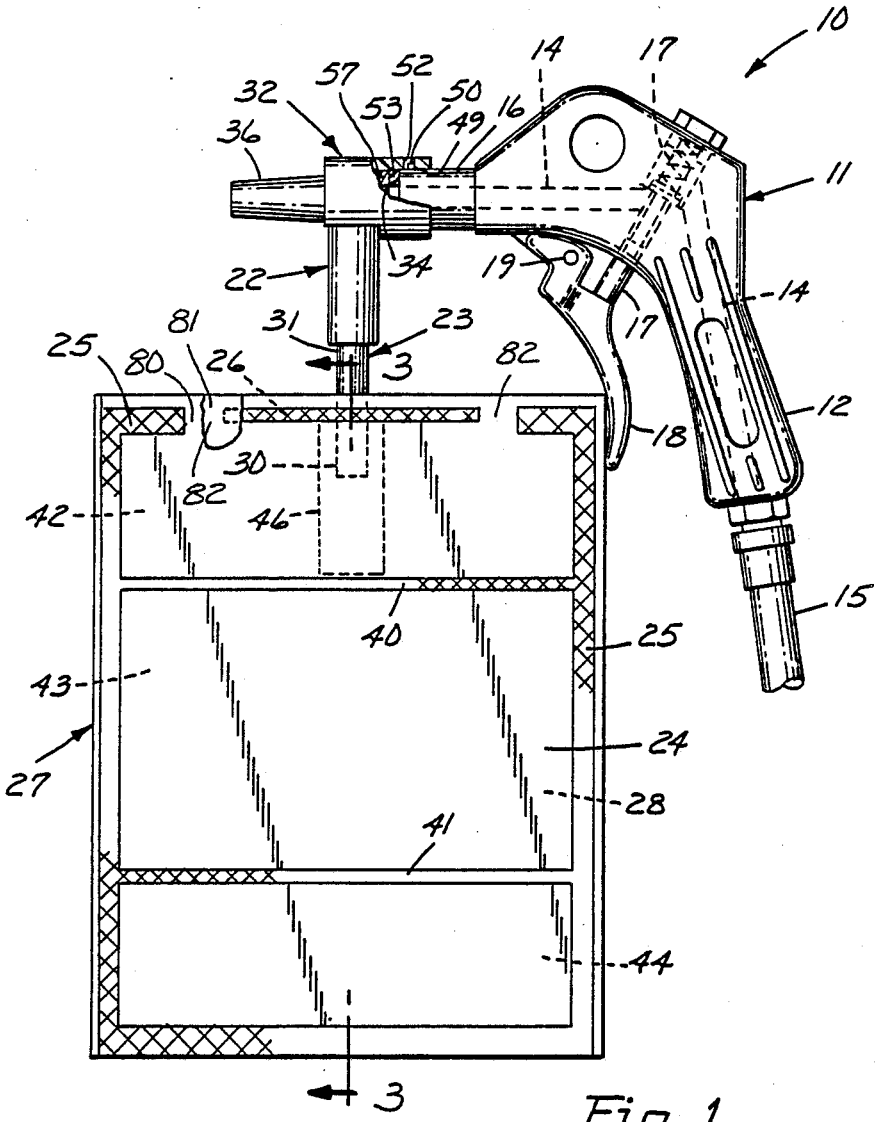
FIG. 1 is a side view of a spray gun according to the present invention attached to a fragment of an air supply hose and having parts broken away to show details.
Figure 2:
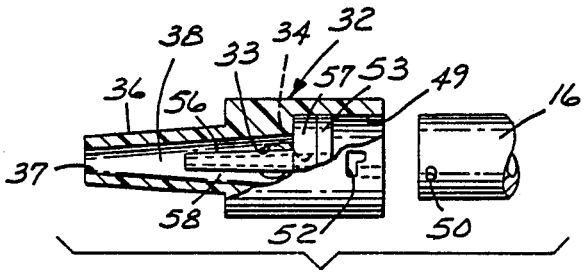
FIG. 2 is a fragmentary top view of the spray gun of FIG. 1 showing a reusable air gun portion separated from a disposable spray nozzle and having parts broken away to show details.

As illustrated in FIGS. 1, 2, 3 and 4, a spray gun 10 comprises (1) a reusable air gun portion 11 including a manually engageable handle 12, having means defining a through passageway 14 including an inlet portion adapted to be attached as by a threaded coupling and a hose 15 to a source of air under greater than atmospheric pressure and an outlet portion 16, and manually operable valve means in the form of an air valve assembly 17 in the through passageway 14 and manually operable by a trigger 18 pivotably mounted on the handle 12 at a pin 19 for controlling the flow air through the passageway 14; and (2) a disposable container and spray nozzle assembly 22. The disposable container and spray nozzle assembly 22 includes a bag like container 27 comprising a tube 23, and at least one sheet 24 of tough flexible material having edge portions 25 attached together and to a central sealing portion 26 of the tube 23 that has in transverse section a generally elongated diamond shape to form the container 27 and define an internal chamber 28 in which liquid is contained with an inlet end portion 30 of the tube 23 within the chamber 28 and an outlet end portion 31 of the tube 23 outside of the chamber 28. Also included in the assembly 22 is an aspirating nozzle 32 having a liquid inlet port 33 connected to the outlet end portion 31 of the tube 23 with the through opening in the tube 23 communicating with the liquid inlet port 33, an air inlet port 34 releasably coupled to the outlet portion 16 of the reusable air gun portion 11, a spray tip portion 36 having an outlet opening 37, a through passageway 38 communicating with the outlet opening 37 and liquid and air inlet ports 33 and 34, and means for forming a vacuum at the liquid inlet port 33 upon movement of air into the air inlet port 34 and out the outlet opening 37 in the spray tip portion 36 so that atmospheric pressure will bias liquid in the chamber 28 into the liquid inlet port 33 to be entrained in air passing out of the outlet opening 37 in the spray tip portion 36.

Figure 3:
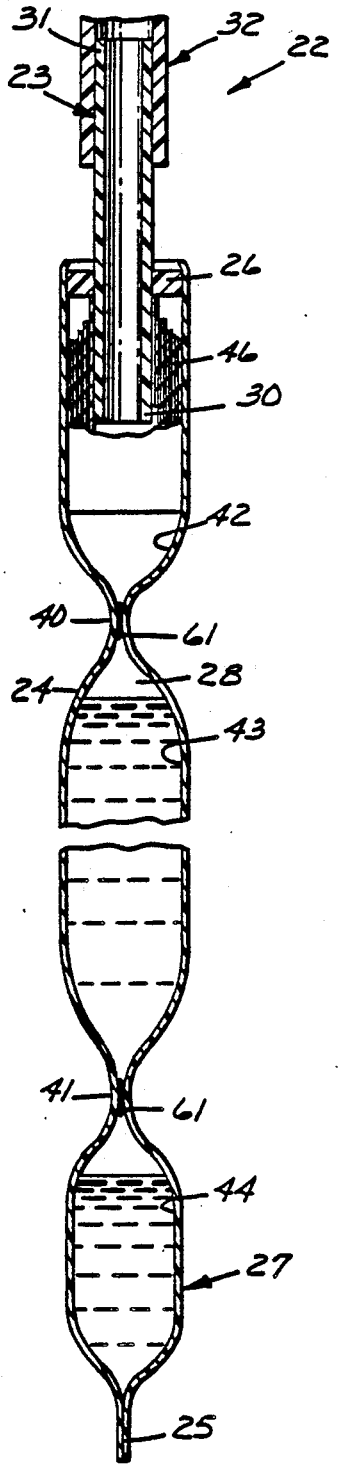
FIG. 3 is a sectional view taken approximately along line 3—3 of FIG. 1.
Figure 4:
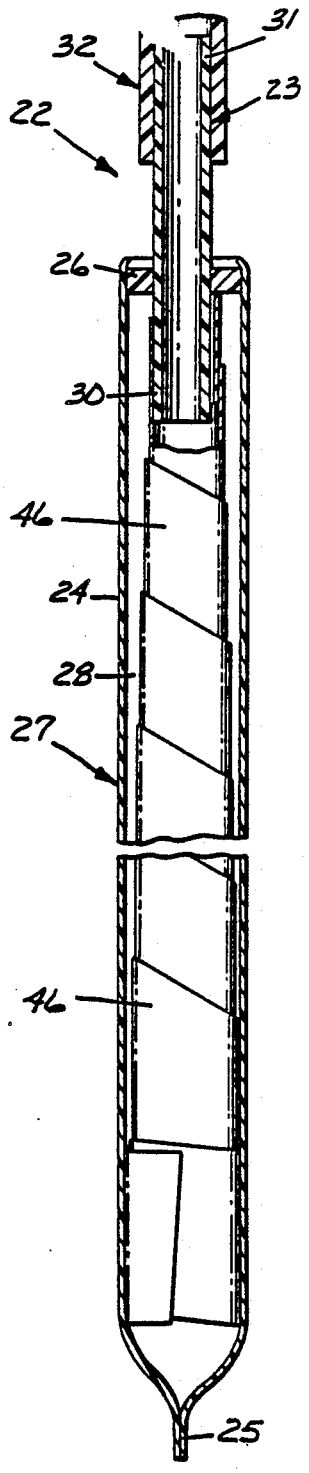
FIG. 4 is a view similar to that of FIG. 3 in which temporary seals have been broken to afford extension of a novel coil included in the spray gun.

The chamber 28 defined by the sheet 24 could be undivided, and the inlet end portion 30 of the tube 23 could be much longer than illustrated and extend toward the end of the chamber 28 opposite its inlet end portion 30 to insure that most of the liquid within the chamber 28 can be dispensed through the spray gun 10. As illustrated, however, as is particularly useful for spraying liquids comprising two components that react with each other and solidify in a short time, portions of the sheet 24 can be attached together along first and second transverse temporary attachment lines 40 and 41 as taught in U.S. Pat. No. 2,932,385 to separate the chamber 28 into first, second and third parts 42, 43, and 44 respectively, with one component of the liquid being contained in the second part 43 of the chamber 28, another component in the third part 44 of the chamber 28, and the inlet end portion 30 of the tube 23 positioned in the first part 42 of the chamber 28 and disposed generally at a right angle to the temporary attachment lines 40 and 41; and the assembly 22 can include a novel extendable tubing means or coil 46 comprising a strip disposed in a plurality of wraps about an axis and having a spring temper biasing the strip to an axially extended position (FIG. 4) with successive wraps of the strip having opposite edge portions overlapping to form a tube like structure. The end of the innermost wrap of the coil 46 is attached axially along the inlet end portion 30 of the tube 23 with the axis of the coil 46 generally aligned with the inlet end portion 30 of the tube 23 and, as is illustrated in FIG. 3, the coil 46 is retained in the first part 42 of the chamber 28 with the wraps overlying each other by the first temporary attachment line 40. The second temporary attachment line 41 can then be manually separated just prior to spraying to afford mixing the first and second components of the liquid by kneading the container 27, and the first temporary attachment line 40 can them be manually separated to afford movement of the coil 46 under the influence of its spring bias to its axially extended position extending toward the end of the chamber 28 opposite the tube 23 so that during spraying the coil 46 will restrict collapse of the container and insure that most of the liquid can be drawn from the chamber 28 through the extended coil 46. Preferably the second temporary attachment line 41 is separated first so that the first and second components of the liquid can be mixed without the coil 46 being extended, and then the first temporary attachment line 40 is separated so that the coil 46 moves to its extended position through the mixed liquid.

The air inlet port 34 is releasably coupled to the outlet portion 16 of the reusable air gun portion 11 by the nozzle 32 having a cylindrical socket 49 adapted to receive a distal part of the cylindrical outlet portion 16 with a pin 50 projecting radially of the outlet portion 16 received in a generally L-shaped groove 52 in the wall defining the socket 49. Upon insertion of the outlet portion 16 into the socket 49 the pin 50 moves along an axially extending portion of the groove 52, whereupon the nozzle 32 and air gun portion 11 are rotated about their axes relative to each other so that the pin moves along a circumferentially extending portion of the groove 52 having a wall that cams the end of the outlet portion 16 into sealing engagement with a rubber gasket 53 in the socket 49 and provides a detent at the end of such movement to retain the pin 50 at the end of the groove 52 until a significant amount of force is applied to again rotate the nozzle 32 and air gun portion 11 relative to each other to separate them.

The means for forming a vacuum at the liquid inlet port 33 upon movement of air into the air inlet port 34 and out the outlet opening 37 in the spray tip portion 36 so that atmospheric pressure will bias liquid in the chamber 28 into the liquid inlet port 33 to be entrained in air passing out of the outlet opening 37 in the spray tip portion 36 comprises a venturi structure within the aspirating nozzle 32. The venturi structure is provided by a hollow cylindrical tube 56 (e.g., 0.376 centimeter inside diameter and an outside diameter tapered from 0.467 to 0.3 centimeter) projecting (e.g., 2.14 centimeters) from a cylindrical disc 57 coaxially received in the inner end of the socket 49, which disc 57 defines at its center the air inlet port 34 which communicates with and is the same size as the central opening in the tube 56. The tube 56 projects centrally into a chamber 58 with which the liquid inlet port 33 communicates, which chamber 58 diverges smoothly and concentrically to the outlet opening 37 (e.g., a chamber 58 diverging from a diameter of 0.91 centimeter around the base of the tube 56 to a diameter of 0.52 centimeter at the outlet opening 37 over a length of 4.13 centimeters) in the spray tip portion 36 of the nozzle 32.

The sheet 24 of tough flexible material from which the container 27 is made is preferably of a laminated material including layers of polyester, aluminum and low density polyethylene such as that material commercially available from Ludlow Corporation, Lombard, Ill., and identified as a laminate of "48 gauge polyester x 0.8#/1000 sq. ft. W-01-978 thermosetting adhesive x 0.00035 aluminum type 1145 x 0.8 #/1000 sq. ft. W-010-978 thermosetting adhesive x 0.003 linear low density, polyethylene (1151B) (0.910–0.925)". The low density polyethylene layer is fused together to form the edge portions 25 and to the central portion 26 of the tube (which is made of a material such as high density polyethylene) to form the chamber 28, and the low density polyethylene layer is heat sealed to both surfaces of a layer 61 of thin porous paper coated on both surfaces with a thin continuous layer of polyethylene to form the temporary transverse lines 40 and 41 that separate the chamber 28 into the parts 42, 43, and 44, and are manually separable to afford mixing of the liquid and extension of the coil 46.

The coil 46 is preferably made from a strip of polyester that is 1.1 inches wide, 24 inches long, and 0.01 inch thick. The strip is wound into a coil having an inside diameter of 0.38 inch and an outside diameter of 0.7 inch, axially extended to an overall length of about 0.5 inch and heat set at about 115 degrees centigrade (240 degrees Fahrenheit) for about 4 minutes so that it has a spring temper biasing it to that extended form.

The reusable air gun portion 11 can be made by cutting the end portion including the dip tube from a commercially available spray gun available from Minnesota Mining and Manufacturing Company, St. Paul, Minn. under the trade designation "Body Schutz Applicator Gun", Part No. 08997.

Preferably, the sheet 24 includes opposed edge segments 80,81 (FIG. 1) that are not attached to each other, thereby forming two vents 82 which communicate the chamber 28 to the atmosphere. The vents 82 substantially eliminate the possibility of bursting of the sheet 24 if, for example, the through passageway 38 becomes unintentionally blocked and the chamber 28 is subjected to line air pressure from the hose 15. After the temporary attachment lines 40,41 are separated and evacuation of the mixed liquid has been initiated, the flexible segments 80,81 press and seal against each other due to negative pressure conditions within the chamber 28 and substantially close the vents 82 to thereby increase the vacuum in the chamber 28 and aid in evacuation of the mixed liquid. The vents 82, however, easily self-open if positive pressure conditions are established in the chamber 28. Additionally, it has been found that locating the vents 82 remote from the coil 46 improves evacuation efficiency since the opposed faces of the sheet 24 may not, in all instances, tightly seal against each other in areas next to the coil 46. Provision of the vents 82 adjacent the first part 42 does not normally enable liquids in the chamber 28 to escape during shipping and storage inasmuch as the liquids are initially separated from the first part 42 by the temporary attachment line 40. As an alternative, vents could instead be provided in the form of holes within the major extent of the flat sides of the sheet 24 adjacent the first part 42.

We claim:

1. A disposable container and spray nozzle assembly for spraying liquid onto a surface when the assembly is attached to a source of air under greater than atmospheric pressure, said assembly comprising:

a tube having a through opening, an outlet end portion, an inlet end portion, and a sealing portion between said inlet and outlet end portions;

at least one sheet of tough flexible material having portions attached together and to said sealing portion of said tube to form a bag like container defining an internal chamber with the inlet end portion of said tube within said chamber and the outlet end portion of said tube outside of said chamber, said at least one sheet having portions attached together along a line of temporary attachment to separate said chamber into first and second parts;

a liquid in said second part of said chamber;

tubing means in said chamber coupled to said inlet portion of said tube and adapted for contact with liquid;

a nozzle having a liquid inlet port connected to said outlet portion of said tube with said through opening in said tube communicating with said liquid inlet port, an air inlet port adapted to be coupled to the source of air under pressure, a spray tip portion having an outlet opening, a through opening communicating between said outlet opening and said liquid and air inlet ports, and means for forming a vacuum at the liquid inlet port upon movement of air into said air inlet port and out said outlet opening in said spray tip portion so that atmospheric pressure will bias liquid in said chamber into said liquid inlet port to be entrained in air passing through said through opening of said nozzle and out of said outlet opening, and a vent in said first part for communicating said chamber with the atmosphere.

2. An assembly according to claim 1 wherein said vent is self-closing under the influence of negative pressure in said chamber.

3. An assembly according to claim 2 wherein said vent is remote from said tubing means.

4. An assembly according to claim 1 wherein said sheet includes edge segments that are not attached together, thereby presenting said vent.

5. An assembly according to claim 1 wherein said tubing means is initially located in said first part and is extendable into said second part upon separation of said line of temporary attachment.

* * * * *

UNITED STATES PATENT AND TRADEMARK OFFICE

CERTIFICATE OF CORRECTION

PATENT NO. : 4,971,251

DATED : November 20, 1990

INVENTOR(S) : Robert P. Dobrick et al.

It is certified that error appears in the above-identified patent and that said Letters Patent is hereby corrected as shown below:

Col. 4, line 56, "0.5" should be — 10.5 — .

Signed and Sealed this

Eighteenth Day of August, 1992

*Attest:*

DOUGLAS B. COMER

*Attesting Officer*

*Acting Commissioner of Patents and Trademarks*